US006083603A

United States Patent [19]

Patel et al.

[11] Patent Number: 6,083,603

[45] Date of Patent: Jul. 4, 2000

[54] FLANGED INSULATION ASSEMBLY AND METHOD OF MAKING

[75] Inventors: Bharat D. Patel, Reynoldsburg; Steven G. Schmitt, Newark; Michael T. Heffelfinger, Westerville, all of Ohio; Rebecca L. Thomas-Dutiel, Surfside Beach, S.C.; Weigang Qi, Westerville, Ohio

[73] Assignee: Owens Corning Fiberglas Technology, Inc., Summit, Ill.

[21] Appl. No.: 09/016,364

[22] Filed: Jan. 30, 1998

[51] Int. Cl.[7] ..... B32B 3/04

[52] U.S. Cl. ..... 428/128; 428/74; 428/192; 156/204; 52/406.2

[58] Field of Search ..... 428/74, 192, 126, 428/128, 129; 52/406.2, 406.1; 156/204

[56] References Cited

U.S. PATENT DOCUMENTS

| | | | |
|---|---|---|---|
| 2,028,253 | 1/1936 | Spafford | 52/406.1 |
| 2,576,698 | 11/1951 | Russum . | |
| 3,307,306 | 3/1967 | Oliver . | |
| 3,729,879 | 5/1973 | Franklin . | |
| 4,172,915 | 10/1979 | Sheptak et al. . | |
| 4,189,089 | 2/1980 | Langen et al. . | |
| 4,189,986 | 2/1980 | Silver . | |
| 4,249,982 | 2/1981 | Ausnit | 156/204 |
| 4,294,640 | 10/1981 | Martinelli et al. . | |
| 4,590,727 | 5/1986 | Ghahremani et al. . | |
| 4,839,126 | 6/1989 | Griesdorn . | |
| 5,362,539 | 11/1994 | Hall et al. . | |
| 5,421,133 | 6/1995 | Berdan, II et al. . | |
| 5,486,401 | 1/1996 | Grant et al. . | |
| 5,545,279 | 8/1996 | Hall et al. . | |
| 5,733,624 | 3/1998 | Syme et al. . | |
| 5,746,854 | 5/1998 | Romes et al.l . | |

FOREIGN PATENT DOCUMENTS

| | | |
|---|---|---|
| WO 97/07968 | 3/1997 | WIPO . |
| WO 97/08401 | 3/1997 | WIPO . |

*Primary Examiner*—Alexander Thomas
*Attorney, Agent, or Firm*—Inger H. Eckert; Stephen W. Barns

[57] ABSTRACT

An insulation assembly includes an elongated batt of fibrous insulation material having two opposed major surfaces, where the batt has a first facing secured on its first major surface. The first facing extends beyond the side edges of the batt to form opposed flanges suitable for attaching the insulation assembly to a building structure. The batt has a second facing secured on its second major surface, with the second facing extending beyond the side edges of the batt to form opposed flanges suitable for attaching the insulation assembly to a building structure. The method of making an insulation assembly includes moving a pack of fibrous insulation material along a path, where the fibrous insulation material has two opposed major surfaces. A continuous encapsulation material is applied to the pack, and a portion of the encapsulation material is continuously gathered to form a two part fold. The two parts of the fold are bonded together to form a flange suitable for attaching the insulation assembly to a building structure.

11 Claims, 4 Drawing Sheets

FLANGED INSULATION ASSEMBLY AND METHOD OF MAKING

TECHNICAL FIELD AND INDUSTRIAL APPLICABILITY OF THE INVENTION

This invention relates to insulation products, and in particular those insulation products of the type suitable for insulating buildings. More specifically, this invention pertains to insulation products having flanges that can be used to install the insulation in buildings.

BACKGROUND OF THE INVENTION

Fibrous insulation is typically formed by fiberizing molten material and depositing the fibers on a collecting conveyor. Most, but not all fibrous insulation products contain a binder material to bond the fibers together, forming a lattice or network. The binder gives the insulation product resiliency for recovery after packaging, and provides stiffness and handleability so that the product can be handled and applied as needed in the insulation cavities of buildings. The fibrous insulation is cut into lengths to form insulation products, and the insulation products are packaged for shipping.

One typical insulation product is an insulation batt, usually 8 feet long, and generally suitable for use as wall insulation in residential dwellings, or as insulation in the attic and floor cavities in buildings. In many insulation applications a vapor barrier is needed on one side or face of the insulation to prevent moisture-laden air from the warm interior of the dwelling from entering the insulation. Otherwise, the water vapor in the warm interior air cools and condenses within the insulation, thereby creating a wet insulation product that can have difficulty performing at its designed efficiency. Vapor barriers are typically created with a layer of asphalt in conjunction with a kraft paper or foil facing. The vapor barrier can also be created by applying a film of moisture impervious material, such as a polyethylene film, to an entire wall containing unfaced insulation. In all cases the vapor barrier is positioned on the warm side, i.e., interior, of the insulation cavity. Also, the opposite major face of the insulation product must be vapor pervious to prevent water from being trapped within the insulation product.

In the past, insulation products have been manufactured with stapling flanges suitable for enabling the insulation installer to attach the insulation product to the studs for wall insulation or to the joists for ceiling insulation. U.S. Pat. Nos. 3,307,306 to Oliver and 3,729,879 to Franklin both disclose insulation products having flanges with an adhesive material to assist in attaching the insulation product to the studs. U.S. Pat. No. 5,421,133 to Berdan et al. discloses a ceiling insulation product having reinforced flanges for attachment to joists.

In a typical installation of fiberglass insulation into wall cavities, the insulation installer inserts the insulation batt into the wall cavity from the interior of the building, with the vapor barrier oriented toward or facing the installer. Typically, the insulation batt is provided with flanges to enable the installer to staple the batt to the studs. Consequently, typical wall cavity insulation has one side or major face having both a vapor barrier and attachment flanges. Where the installer is insulating the ceiling of a basement or a crawl space, the vapor barrier must be placed away from the installer. This makes it impossible to use the attachment flanges of the typical wall cavity insulation since the flanges are positioned deep within the ceiling cavity.

Recent advances in manufacturing insulation products have resulted in insulation materials that rely on encapsulation materials for containing and handling purposes, and do not require any binder material to bond the insulation fibers to each other. As disclosed in U.S. Pat. No. 5,545,279 to Hall et al. the insulation material can be encapsulated in an in-line process. The primary use for such encapsulated insulation products is attic insulation since this type of insulation product is difficult to install in wall cavities or in underfloor ceiling cavities. Although attachment flanges could be added to the encapsulated insulation batts, this would not be economically practical.

It would be advantageous if there could be developed an insulation product or insulation assembly that could have attachment flanges created in an inexpensive manner. Further, it would be beneficial if there could be developed an insulation product that could be universally applied to either a wall cavity or a ceiling cavity.

SUMMARY OF THE INVENTION

The above objects as well as other objects not specifically enumerated are achieved by an insulation assembly including an elongated batt of fibrous insulation material having two opposed major surfaces, where the batt has a first facing secured on its first major surface. The first facing extends beyond the side edges of the batt to form opposed flanges suitable for attaching the insulation assembly to a building structure. The batt has a second facing secured on its second major surface, with the second facing extending beyond the side edges of the batt to form opposed flanges suitable for attaching the insulation assembly to a building structure.

In a specific embodiment of the invention, the insulation assembly includes an elongated batt of fibrous insulation material having two opposed major surfaces and longitudinal corners at the intersection of the major surfaces and the sides of the batt. The batt has an encapsulation material on a major surface and encapsulation material on the sides of the batt. A flange is positioned at a corner of the batt. The flange is formed from a bonded two part fold of the encapsulation material, and the flange is suitable for attaching the insulation assembly to a building structure.

In another embodiment of the invention, the method of making an insulation assembly includes moving a pack of fibrous insulation material along a path, where the fibrous insulation material has two opposed major surfaces. A continuous encapsulation material is applied to the pack, and a portion of the encapsulation material is continuously gathered to form a two part fold. The two parts of the fold are bonded together to form a flange suitable for attaching the insulation assembly to a building structure.

In another embodiment of the invention, the method of making an insulation assembly includes moving a pack of fibrous insulation material along a path, where the fibrous insulation material has two opposed major surfaces. A continuous encapsulation material is applied to the pack, and a portion of the encapsulation material is continuously gathered and drawn through pinch rolls to continuously form is a shaped corner in the encapsulation material.

In yet another embodiment of the invention, the method of making an insulation assembly includes processing a continuous encapsulation material to form two continuous flanges suitable for being attached to a building structure. A pack of fibrous insulation material is moved along a path, where the fibrous insulation material has two opposed major surfaces. The continuous encapsulation material is applied to the pack to form an encapsulated insulation assembly, wherein one of the major surfaces has the two flanges in an opposed relationship so that the insulation assembly can be attached to the building structure by attaching the flanges to the building structure.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

While the description and drawings disclose insulation assemblies of fiberglass insulation, it is to be understood that the insulation material can be any compressible insulation material, such as mineral wool.

Figure 1:
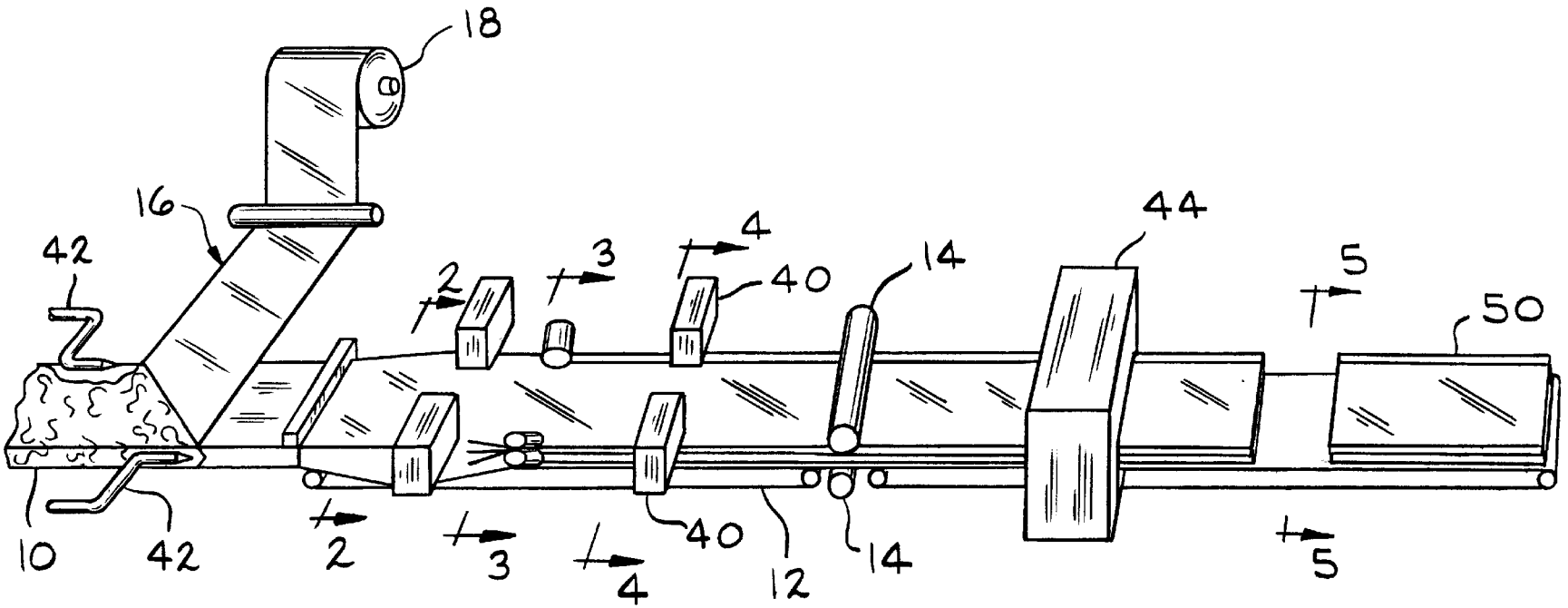
FIG. 1 is a schematic perspective view of insulation encapsulation equipment for making insulation assemblies according to the present invention.

As shown in FIG. 1, a pack 10 of glass fibers is being carried on a conveyor 12. The manufacture of the glass fiber pack 10 is well known technology, and those skilled in the art will be aware of several conventional methods for producing glass fiber packs. The glass fiber pack is preferably a light density insulation material, having a density within the range of from about 0.3 to about 1.0 pounds per square foot (pcf). Optional pull rolls 14 can be used to pull the glass fiber pack through the apparatus.

Figure 2:
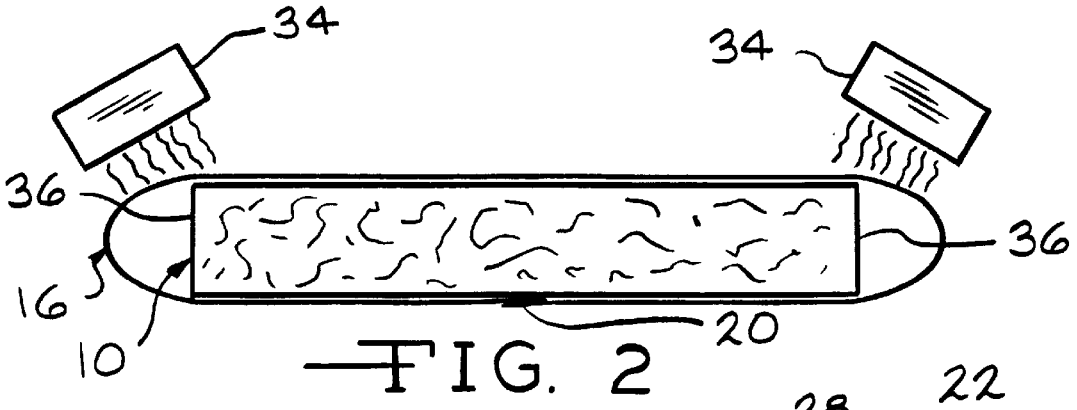
FIG. 2 is a schematic view in elevation of insulation assembly of FIG. 1 taken along line 2—2.

A sheet of encapsulation material 16 is payed out from roll 18 and fed by a folding apparatus, not shown, to surround or encapsulate the glass fiber pack. Apparatus suitable for directing and guiding the encapsulation material onto the glass fiber pack is disclosed in U.S. Pat. No. 5,545,279 to Hall et al., which is hereby incorporated by reference in its entirety. The encapsulation material 16 is preferably a polymer film, such as a polyethylene film, although other films such as a polypropylene film can be used. Coextruded films could also be used, with the two layers of the coextruded film having different softening points. The encapsulation material is preferably less than about 1.0 mil in thickness, and more preferably less than about 0.5 mil in thickness. As shown in FIG. 2, the encapsulation material 16 loosely surrounds the pack of glass fibers. The film can be overlapped at overlap joint 20 and bonded together by any means, such as by an adhesive.

Figure 3:
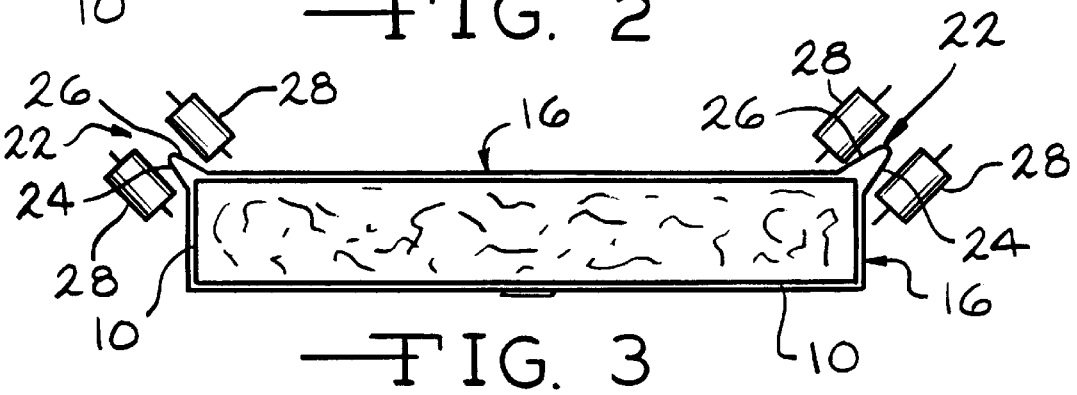
FIG. 3 is a schematic view in elevation of insulation assembly of FIG. 1 taken along line 3—3.

FIG. 3 illustrates that some of the encapsulation material 16 is gathered into a two part fold 22 consisting of a side part 24 and a top part 26. The gathering of the encapsulation material into the two part fold 22 can be accomplished by several means, including guide shoes, not shown, a vacuum apparatus, not shown, or a pair of cooperating pinch rolls 28 mounted for rotation. The pinch rolls 28 are driven by means not shown in manner to pull or draw the encapsulation material away from the glass fiber pack 10 to form the two part fold 22. For purposes of clarity, the spacing between adjacent pinch rolls 28 is exaggerated in FIG. 3.

Figure 5:
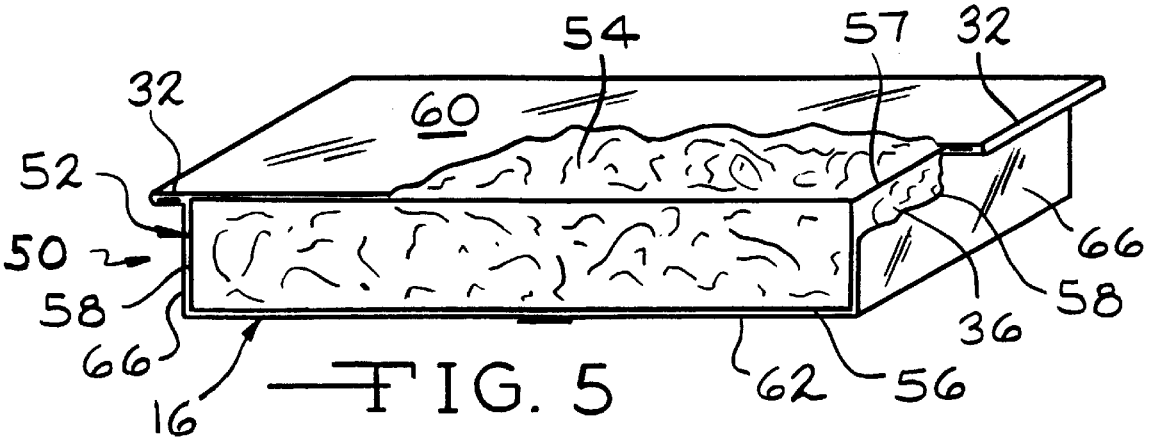
FIG. 5 is a schematic view in elevation of insulation assembly of the invention.

The pinching of the side part 24 and the top part 26 of the two part fold 22 can be used to form the desired flange, indicated at 32 in FIG. 5, in the ultimate insulation product. This requires a bonding of the two parts 24 and 26 of the fold together to form the flange. This bonding can take place in several ways. As shown in FIG. 2, heaters 34 can be positioned above the sides 36 of the insulation pack 10. The heating of the encapsulated material 16 prior to the pinching of the two part fold in the rollers 28 enables the pinching of the two part fold 22 to bond the side part 24 to the top part 26 to form the flange 32. For this purpose, the pinch rollers 28 can be cooled so that the softened encapsulation material will not stick to the pinch rollers.

Figure 4:
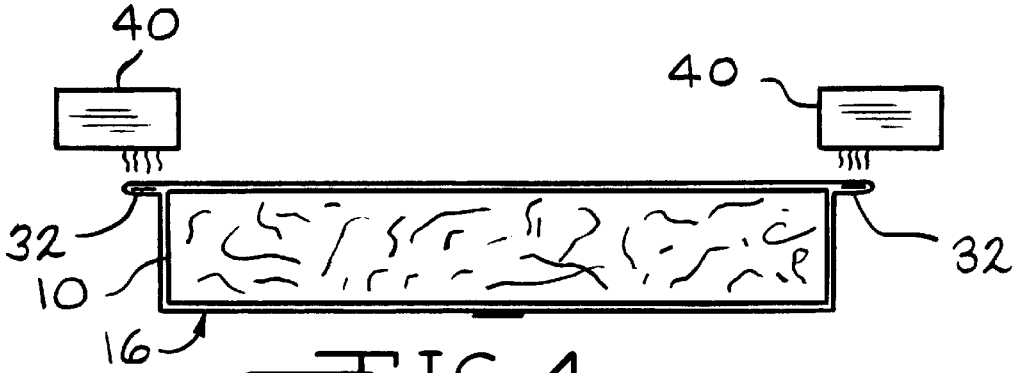
FIG. 4 is a schematic view in elevation of insulation assembly of FIG. 1 taken along line 4—4.

Another method that can be employed to bond the side part 24 to the top part 26 to form the flange 32 is to apply heat to the two part fold after folded material leaves the pinch rollers, but while the material is still maintained in a folded condition. The heating of the encapsulation material will soften the material and bond the two parts 24 and 26 together. This heat can be provided by a radiant heater 40, as shown in FIGS. 1 and 4. Another alternative to binding the two parts together to form the flange 32 is to use ultrasound energy generated from means, not shown, in place of the radiant heaters 40.

An adhesive can be deposited on the encapsulation material 16 that is gathered into the two part fold. The adhesive brings about the bond needed to form the flange 32. As illustrated in FIG. 2, adhesive nozzles 42 can be positioned to inject an appropriate adhesive.

While the apparatus illustrated in FIG. 1 indicates that the flange 32 is formed in-line during or immediately prior to the encapsulation process, it is to be understood that the forming of the flanges can be carried out in a prior operation. In such a case, the flanged encapsulation material can be supplied in a roll similar to the 18. The forming of the flanges in the encapsulation material in an off-line process, not shown, can be accomplished by any of the processes described above, or by any other known means.

After the bonding of the two parts 24 and 26 to form the flange 32, the encapsulated, flanged pack of glass fibers 10 is cut by cutting apparatus 44 to form individual encapsulated batts or insulation assemblies 50. The completed insulation assembly 50, as shown in FIG. 5, is made of an elongated insulation batt 52 and the encapsulation material 16. The batt has a top or first major surface 54 and a bottom or second major surface 56. The two opposed major surfaces 54 and 56 intersect the sides 36 of the batt at longitudinal corners 57. The first or top facing 60 extends beyond the longitudinal or side edges 36 of the batt to form the two opposed flanges 32 that are suitable for attaching the insulation assembly to a building structure. The bottom facing 62 is secured to the second major surface or bottom surface 56 of the batt 52. The sides 58 of the batt are covered or faced with side encapsulation material 66. It is to be understood that a single flange rather than a pair of opposed flanges 32 might be sufficient for some insulation products.

Figure 8:
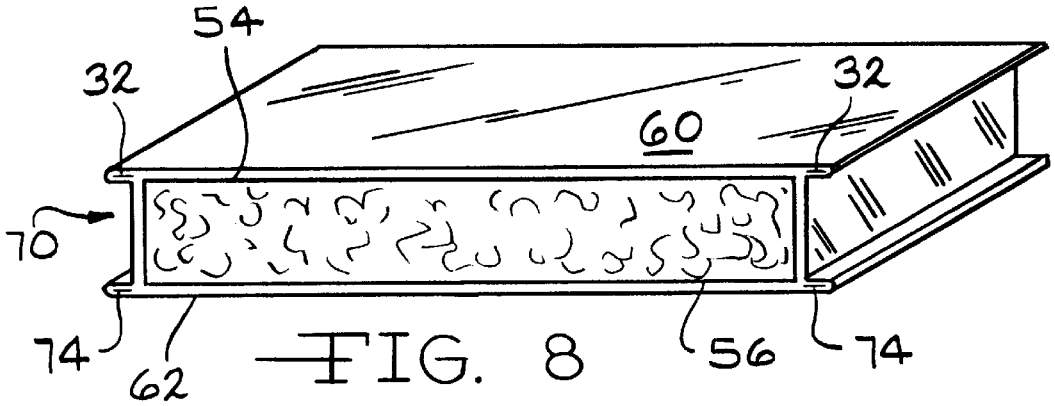
FIG. 8 a schematic perspective view of an encapsulated insulation assembly having attachment flanges on both major faces.

As shown in FIG. 8, in another embodiment of the invention the insulation assembly 70 has not only a top facing 60 with flanges 32, but also a bottom facing 62 that forms opposed flanges 74 extending beyond the side edges 58 of the batt. The flanges 74 are suitable for attaching the insulation assembly to a building structure. This insulation assembly 70 can be referred to as a four corners batt or a four flanged batt. The bottom flanges 74 can be formed in a manner similar to the forming of the flanges 32 in the top surface 60 as described above. While the flanges 32 and 74 are shown as being at the corners of a cross section of the insulation assembly, i.e., attached to one of the major surfaces 54 or 56 of the batt, it is to be understood that the flanges could be positioned at mid point of the side 58 of the batt where such a positioning of the flange would be advantageous.

One of the principle advantages of forming a four flanged batt such as insulation assembly 70 with flanges (32 and 74) positioned at each corner of the product is that the batt is much more versatile in its application into a building structure. By providing a flanged facing 60 and 62 on both the first and second major surfaces 54 and 56 of the batt, either of the two major insulation assembly facings 60 or 62 can be initially exposed when the insulation assembly is installed into an insulation cavity. When one of the major surfaces 54 or 56 is provided with vapor barrier properties, the versatility of the four flanged batt enables the batt to be placed in the cavity with the vapor barrier facing being either initially exposed or initially covered up.

Figure 6:
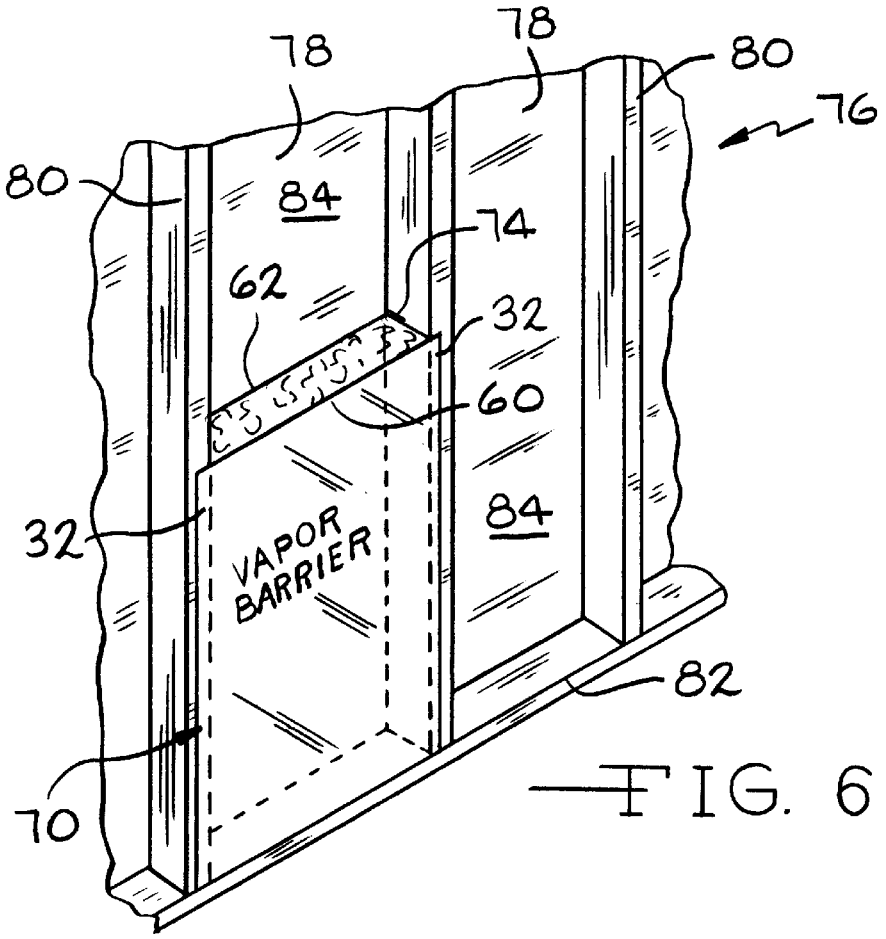
FIG. 6 is a schematic perspective view of insulation assembly of FIG. 1 applied to a wall cavity in a building.

As shown in FIG. 6, a wall section, indicated at 76, includes several wall cavities 78 defined by studs 80, a header, not shown, a footer 82, and sheathing material 84. An insulation assembly 70 is placed in one of the wall cavities, with the first facing material 60, being a water vapor impervious material, directed or oriented toward the interior of the building, and the second facing material 62 being water vapor pervious and oriented toward the exterior of the building. The placement of the batt with the vapor barrier, i.e., facing 60, toward the interior of the building prevents the moisture-laden air from the interior of the building from entering the insulation material. The insulation assembly is installed by stapling the flanges 32 to the studs. The flanges 74 on the rear or second facing material 62 are superfluous for this application, and are tucked away as shown.

Figure 7:
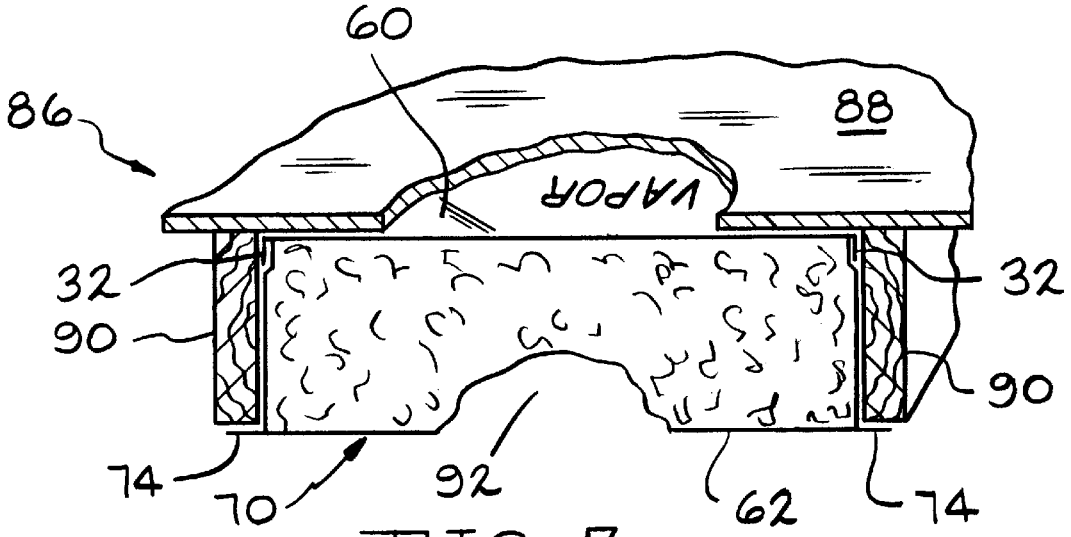
FIG. 7 is a schematic perspective view of insulation assembly of FIG. 1 applied to a ceiling cavity in a building.

In contrast to what is shown in FIG. 6, the floor section 86 shown in FIG. 7 uses the insulation assembly 70 in a reverse orientation. The floor section includes flooring material 88 and a plurality of floor joists 90 that define ceiling cavities 92. Above the flooring material is the interior of the building, and below the flooring material is the basement or crawl space, which is unheated. The preferred insulation design is to position the vapor barrier on the interior or warm side of the ceiling cavity. Therefore, the insulation assembly is installed with the vapor barrier oriented toward the flooring material, away from the installer. The insulation assembly is attached to the floor joists 90 with the flanges 74 of the bottom or vapor pervious facing 62. The flanges 32 on the first or top facing material 62, which is impervious to water vapor, are superfluous for this application, and are tucked away as shown.

In a similar manner to the installation shown in FIG. 7, the insulation assembly 70 can be installed as attic insulation in the floor of an attic, not shown, with the vapor barrier oriented away from the installer who is installing the insulation in the attic. The vapor barrier would be away from the installer, on the bottom or warm side of the attic insulation cavity.

Figure 9:
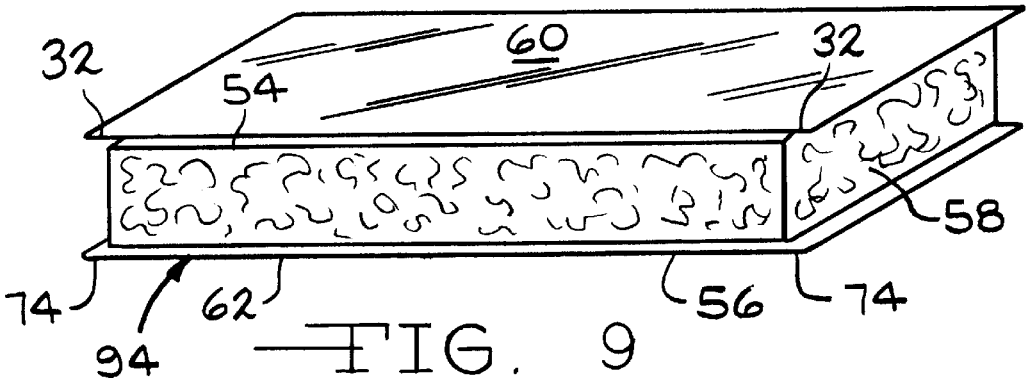
FIG. 9 is a schematic perspective view of an unencapsulated insulation assembly having attachment flanges on both major faces.

In another embodiment of the invention, as shown in FIG. 9, an insulation assembly 94 can be made with no encapsulation material. The sides 58 of the batt 52 are exposed. In all other respects the insulation assembly 96 is the same as insulation assembly 70 in FIG. 8.

Figure 10:
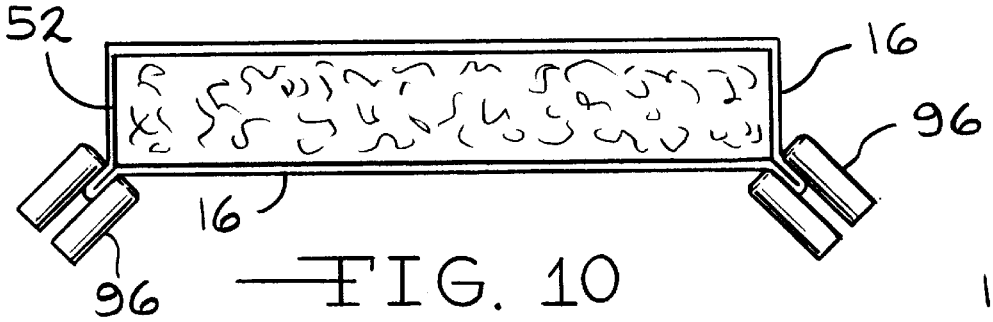
FIG. 10 is a schematic view in elevation of an insulation assembly with the corners of the encapsulation material being pinched to form a creased corner.
Figure 11:
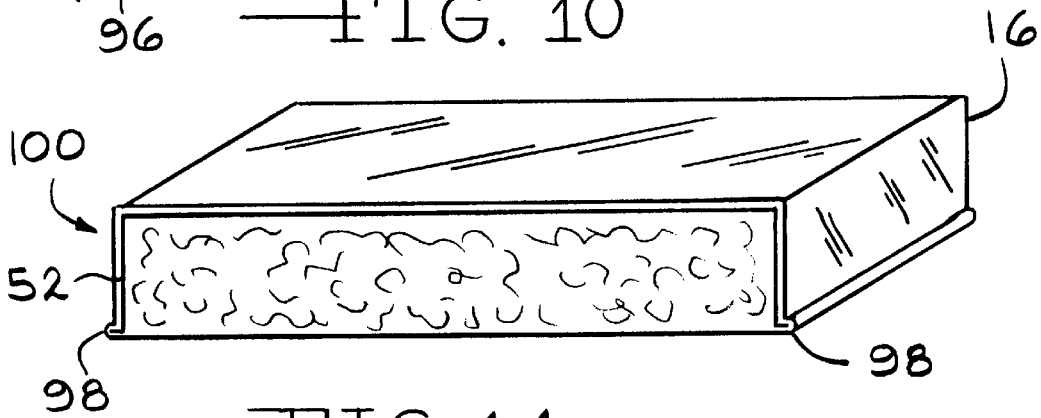
FIG. 11 is a schematic view in elevation of the insulation of FIG. 10 having a creased corner.

In another embodiment of the invention, as shown in FIGS. 10 and 11, pinch rollers 96 can be used to pinch the encapsulation material 16 to form creased corners 98. Optionally, the creasing of the corners can be supplemented with heating or the addition of resinous material, not shown, to reinforce or stiffen the crease. The resulting insulation assembly 100 will exhibit a more stable structure that more easily fills out the corners of a rectangular insulation cavity. In another variation of the invention, the pinching and creasing of the corners of the insulation assembly 100 can include pinching a small portion of the fiberglass insulation material to supplement and reinforce the pinched corner 98.

The principle and mode of operation of this invention have been described in its preferred embodiments. However, it should be noted that this invention may be practiced otherwise than as specifically illustrated and described without departing from its scope.

What is claimed is:

1. An insulation assembly comprising an elongated batt of fibrous insulation material having two opposed major surfaces and longitudinal corners at the intersection of the major surfaces and the sides of the batt, the batt having a continuous piece of encapsulation material applied to the major surfaces and the sides of the batt to form a single overlap joint on one of the major surfaces of the batt, with a flange positioned at a corner of the batt, the flange being formed from a bonded two part fold of the encapsulation material, and the flange being suitable for attaching the insulation assembly to a building structure.

2. The insulation assembly of claim 1 wherein the two parts of the fold are bonded together with an adhesive.

3. A method of making an insulation assembly comprising:

moving a pack of fibrous insulation material along a path, the fibrous insulation material having two opposed major surfaces and longitudinal corners at the intersection of the major surfaces and the sides of the batt;

applying a continuous piece of encapsulation material to the opposed major surfaces and the sides of the batt to form a single overlap joint on one of the major surfaces of the batt;

continuously gathering a portion of the encapsulation material to form a two part fold; and bonding the two parts of the fold together to form a flange suitable for attaching the insulation assembly to a building structure.

4. The method of claim 3 including heating the encapsulation material prior to forming the part fold.

5. The method of claim 3 including drawing the two part fold through two pinch rolls.

6. The method of claim 3 including bonding the two parts of the fold by applying heat to the fold.

7. The method of claim 3 including bonding the two parts of the fold by applying sonic energy to the fold.

8. The method of claim 3 including bonding the two parts of the fold by applying an adhesive to the fold.

9. The method of claim 3 including drawing the two part fold through two pinch rolls.

10. The method of claim 3 wherein the batt has longitudinal corners at the intersection of the major surfaces and the sides of the batt, and wherein the flange is positioned at a longitudinal corner of the batt.

11. A method of making an insulation assembly comprising:

moving a pack of fibrous insulation material along a path, the fibrous insulation material having two opposed major surfaces and longitudinal corners at the intersection of the major surfaces and the sides of the batt;

loosely applying encapsulation material to the opposed major surfaces and the sides of the batt;

continuously gathering a portion of the encapsulation material to form a two part fold; and bonding the two parts of the fold together to form a flange suitable for attaching the insulation assembly to a building structure.

* * * * *